US006073900A

United States Patent [19]

Chapman

[11] Patent Number: 6,073,900

[45] Date of Patent: Jun. 13, 2000

[54] METHOD AND APPARATUS TO RESTRAIN OBJECTS

[75] Inventor: Nicholas J. Chapman, Fremont, Calif.

[73] Assignee: Darco Trust, State Line, Nev.

[21] Appl. No.: 08/276,436

[22] Filed: Jul. 18, 1994

[51] Int. Cl.[7] ..... A47K 1/08

[52] U.S. Cl. ..... 248/313; 248/230.9; 248/230.8

[58] Field of Search ..... 248/505, 230, 248/231, 313, 230.1, 230.8, 230.9

[56] References Cited

U.S. PATENT DOCUMENTS

| | | | |
|---|---|---|---|
| 1,181,377 | 5/1916 | Dowell | 248/505 |
| 3,894,707 | 7/1975 | Heard | 248/231 |
| 4,955,573 | 9/1990 | Horvath | 248/313 |
| 5,020,760 | 6/1991 | Mayr | 248/313 |
| 5,022,624 | 6/1991 | Hill | 248/274 |
| 5,190,260 | 3/1993 | Daubenspeck | 248/313 |
| 5,344,111 | 9/1994 | Gantzert | 248/274 |

*Primary Examiner*—Ramon O. Ramirez
*Assistant Examiner*—Gwendolyn Baxter
*Attorney, Agent, or Firm*—Herbert C. Schulze

[57] ABSTRACT

A method and apparatus for protecting objects from damage during an earthquake or the like which includes fastening brackets to a structure and securing the object to the structure by means of a strap-like member connected to the object and the brackets in such a manner that slight controlled movement of the object is allowed in the nature of a dampening, or shock absorbing action.

1 Claim, 5 Drawing Sheets

METHOD AND APPARATUS TO RESTRAIN OBJECTS

CROSS REFERENCE TO RELATED PATENT APPLICATIONS

This application is not related to any other application filed by me.

BACKGROUND OF THE INVENTION

1. Field of the Invention

This invention is in the general field of restraint of objects to prevent damage due to physical shock, or the like.

The invention is even more particularly in the field of restrain of objects located within structures and the like;

The invention is most particularly in the field of a unique method and apparatus for restraining objects in structures or the like when subjected to severe stress, such as may be caused by an earthquake or other physical impact.

2. Description of the Prior Art

In the past there have been attempts to provide proper restrain for objects such as water heaters, refrigerators, water coolers, cabinets, and the like, as described in the summary of the invention, which follows. In this invention, however, I have provided a unique strap and angular anchoring arrangement. I know of no prior art which approaches this problem in the manner of this invention.

SUMMARY OF THE INVENTION

There is an ever increasing awareness of the damage cause by earthquakes. In addition there is an awareness of the damage caused by other types of physical shock, such as out of control vehicles striking house and the like.

Under such circumstances as an earthquake, or the like, many structures may not be demolished, or even severely damaged. However, the shock will cause unstable articles in the structure to move and suffer considerable damage. A few examples are water heaters, other appliances, cabinets, and the like. In the case of cabinets, it is not uncommon for valuable articles, such a glass, porcelain, and the like to be destroyed.

Some people have attempted to secure there objects which might be susceptible to such damage as has been mentioned, by bolting to a floor or wall—or even to another object. Some have used wires, common electrical conduit of plumbing strapping, and the like, for such restraint. None of the methods and devices of which I am aware has ever been satisfactory. Additionally, such attempts will, in themselves, actually impart additional damage to the objects. Improperly wired, bolted, or otherwise secured objects may be damaged by the very rigid and destructive restraining means.

I have now conceived and developed a method and device which provides extremely effective protection for objects of the nature indicated above.

I have provided unique sets of angle brackets, together with an specially designed strapping which anchors objects securely to walls, or the like, of a structure. One of the important unusual features of this invention is the provision of oval slots, or oversized holes, for the securing of bolts and the like. The bolts and other anchoring devices are round. This combination allows limited movement, which can continue through the continued deflection and movement which is always present in an earthquake or the like. The limited movement provided by this method, which can continue throughout the duration of earth or other movement, provides a dampening effect—much like the effect of a spring, shock absorber, or the like.

It is an object of this invention to provide a method and apparatus to secure, and prevent violent movement of, objects within a structure, or the like, when the structure, or the like, is subjected to unusual physical forces;

Another object is to provide such a method and apparatus which will supply a regulated dampening effect on the secured objects;

Another object is to provide such a method and apparatus which will not, of itself, damage the secured objects.

The foregoing, and other, objects and advantages of this invention will become apparent to those skilled in the art upon reading the description of a preferred embodiment, which follows, in conjunction with a review of the appended drawings.

DESCRIPTION OF A PREFERRED EMBODIMENT

In practicing the method of this invention, the first requirement is to locate the object to be protected in a most desirable position to take advantage of the unique features of this invention.

Figure 1:
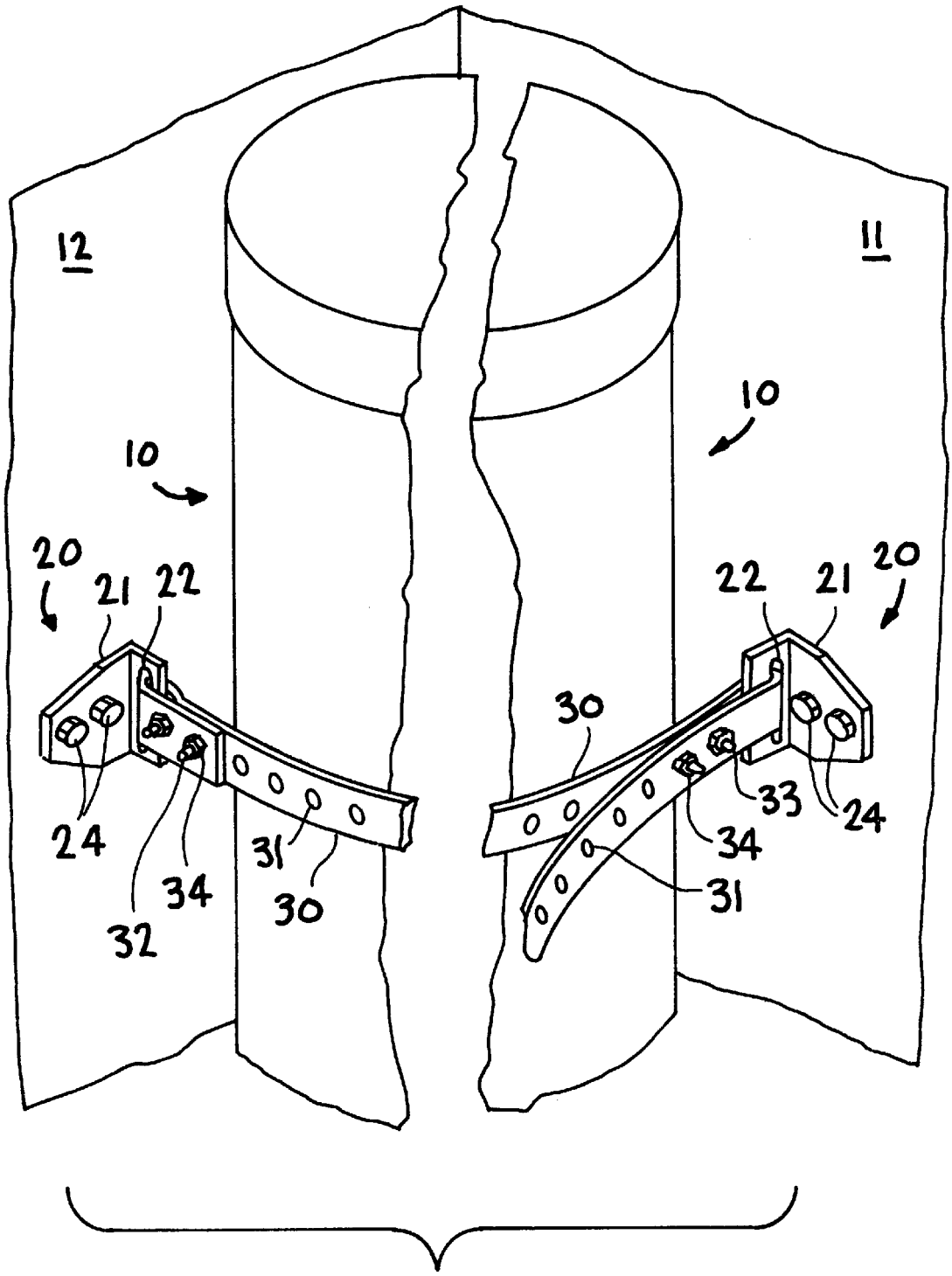
FIG. 1 is a perspective partially broken away, view of a water heater being secured according to the method of this invention.

In FIG. 1, a highly desirable location for a water heater, or the like 10 is indicated at the intersection of two walls, 11 and 12. The restraining device 20 of this invention is shown partially broken away.

Figure 2:
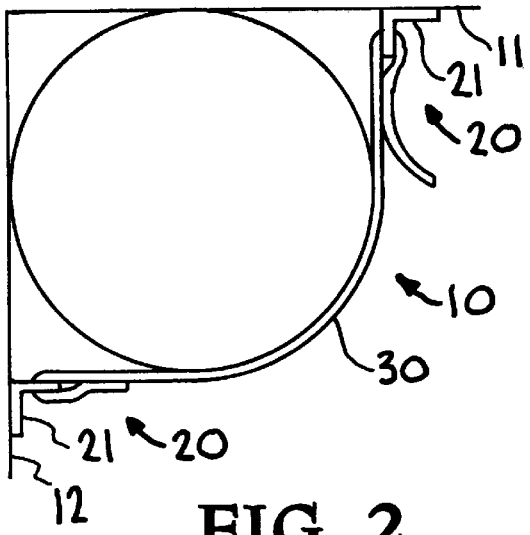
FIG. 2 is a top plan of FIG. 1, in reduced scale, and not broken away.

FIG. 2 shows, from a top plan view, the installation of the apparatus of this invention 20 (some details omitted) to provide proper restraint in case of an earthquake or other disturbance.

Figure 3:
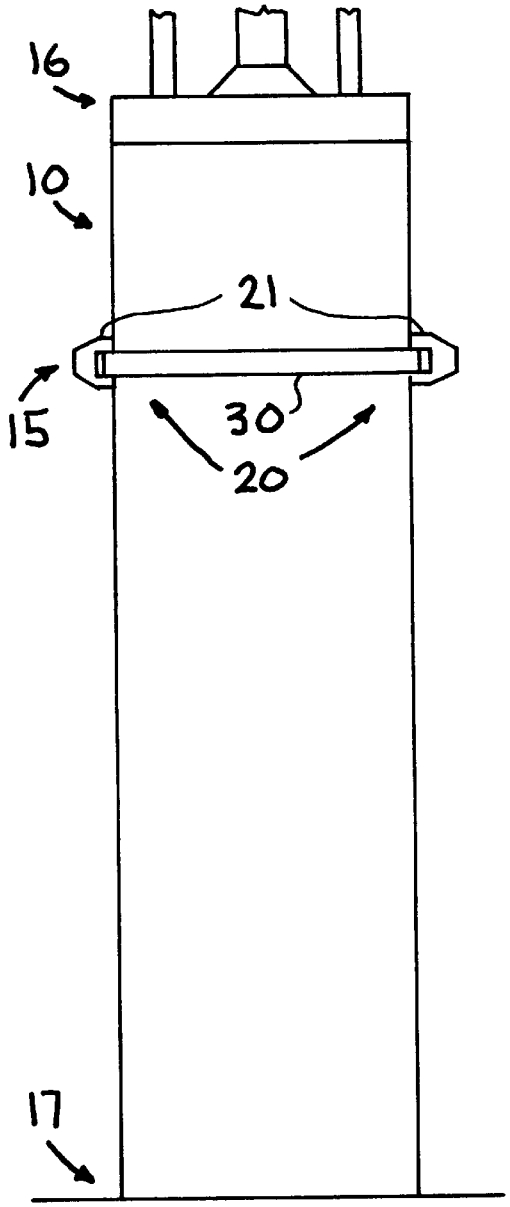
FIG. 3 is view of the complete water heater of FIG. 1, in reduced scale, and not broken away, and indicating the preferred location of the apparatus of this invention in practicing the method of this invention.

FIG. 3 illustrates the ideal vertical location of the restraint 20 of this invention. The top 16 of the restrained device 10 is indicated. The ideal location of the restraining strap and device 20 is shown at 15, which is one third of the distance from the top 16 of the device to the bottom 17, thereof.

Figure 4:
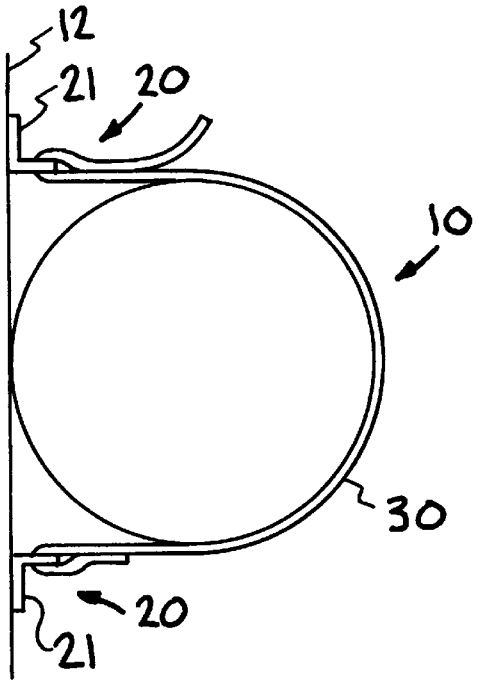
FIG. 4 is a view similar to FIG. 2, but showing a side wall anchorage, rather than a corner as in FIG. 2.

FIG. 4 shows the installation of a water heater along a flat wall, as opposed to the corner installation of FIG. 2.

Figure 5:
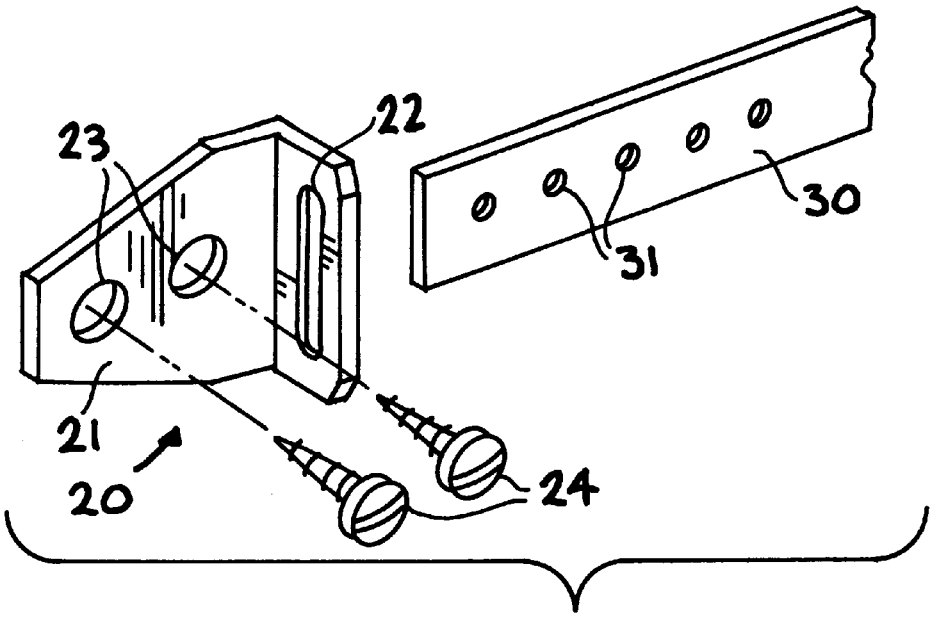
FIGS. 5, 6, 7 & 8 are exploded views, partially broken away, showing the various elements of the apparatus used in the invention.

FIG. 5 shows the elements of a device suitable to practice the method of this invention. The bracket 21 having oversized, or oval holes 23, lag bolts 24, and elongated strap slot 22. The enlarged or oval holes 23 and the elongated slot 22 provide sufficient movement for the dampening, or shock absorbing movement. This can be compared to the wing movement of an aircraft. In riding on an aircraft, it can be observed that the wings actually flop up and down—if this did not happen, they would snap off. The same principle has been applied here, where the minor movement absorbs the shock.

Likewise, the holes 31 in strap 30 are sufficiently enlarged to provide a slight movement under extreme shock.

Figure 6:
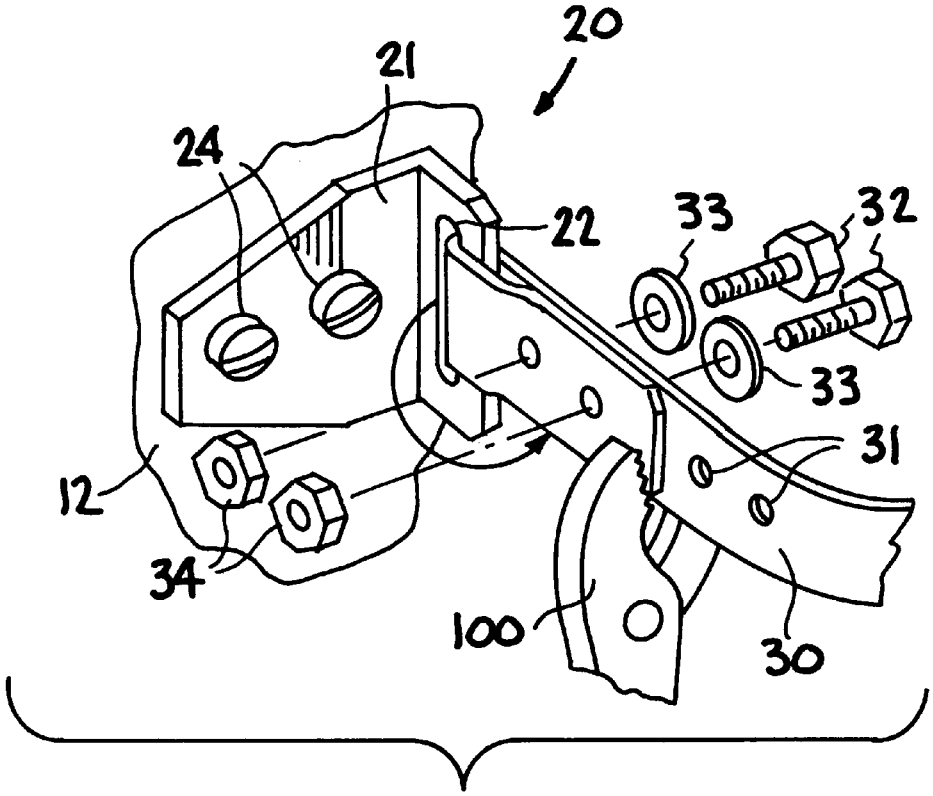

FIG. 6 shows the clamping of the strap 30 through slot 22 by use of a pliers 100, or other means. The bolts 32 are inserted through washers 33 and holes 31. They are then secured by nuts 34.

Figure 7:
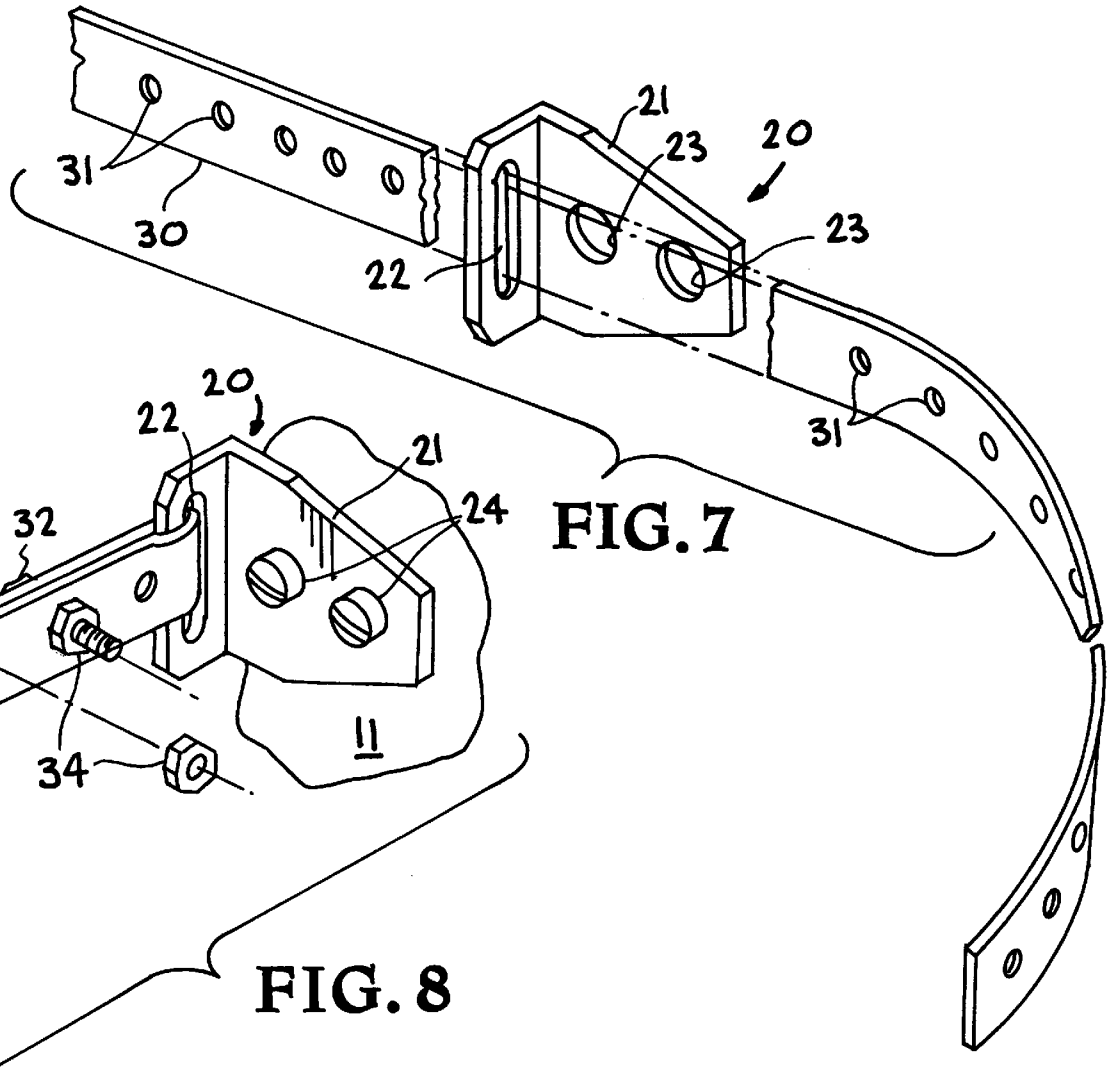
Figure 8:
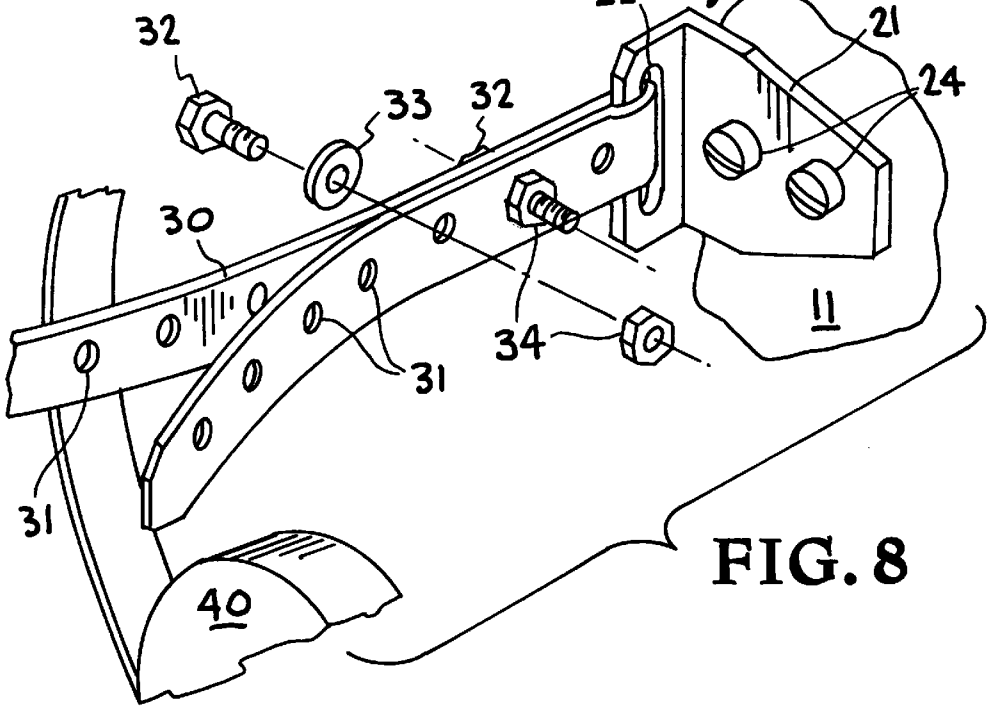

The same elements are indicated at the other end in FIGS. 7 and 8. In FIG. 8 a roll of suitable plastic tape or the like, 40 is shown. This tape is preferably used to encompass the end of the strap so as to avoid injury to one brushing against it, or the like.

Figure 9:
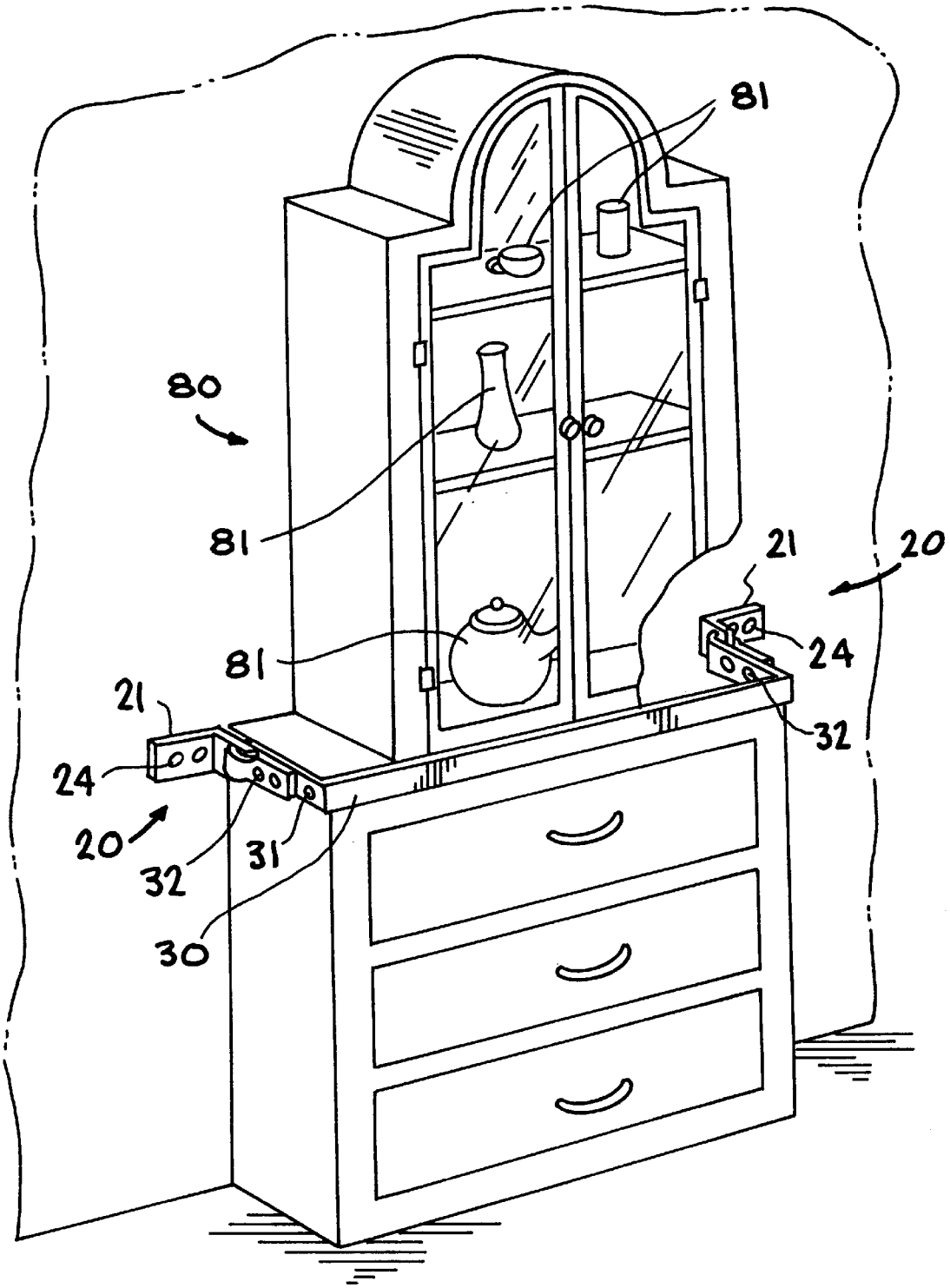
FIG. 9 is a perspective showing the securement of a cabinet by the apparatus and method of this invention.

FIGS. 9 and 10 show this invention in use to protect a cabinet or the like. A cabinet 80 is shown, having porcelain, glass, or other delicate objects 81 in its upper display portion. Presumably, and preferably, the closure of the doors of the display portion will be locked, by means not shown, but well known to those skilled in the art. Likewise the drawers will be locked in customary manner, not shown. In this case, the height of the securing strap will not normally be in the dimensions shown in FIG. 3. The reasons for this are that a study of the normal dimensions and centers of gravity of items such as a cabinet as shown in FIG. 9 will be such that the dimensions and location of the restraint will shift accordingly.

Perhaps a more accurate description of the location of the strap than as indicated in FIG. 3 would be at, or near a position approximating three quarters of the distance of the center of gravity of the object being secured above the base upon which it rests.

I have not described the material of which the brackets, fasteners, straps, and other elements used in this invention are composed. This is only of importance in evaluating the strength required in each instance. For most applications I find that stainless steel is ideal. Stainless steel has many desirable qualities, including resistance to deterioration by reason of oxidation and the like. However, certain other materials are fully suitable, and the ever evolving technology, new and distinct materials may be even more desirable. Those skilled in the art will be able to implement the principles of this invention by substituting other materials.

The embodiments and materials recited herein are only for purposes of illustration, and not for the purposes of limitation. It is intended that this invention be evaluated and its principles included in all of its basic concepts and without limitation to specifics.

I claim:

1. Apparatus to restrain movement of an object associated with a structure which is subject to severe physical shock including, in useful and cooperative relationship: a first bracket bolted to the structure by bolts through holes in said first bracket which holes are enlarged with respect to the size of the bolts and a strap-like member fastened to said first bracket through an elongated slot in the first bracket, which slot is longer than the width of the strap-like member.

* * * * *